US007445585B2

(12) United States Patent
Domenge

(10) Patent No.: US 7,445,585 B2
(45) Date of Patent: Nov. 4, 2008

(54) INERTIAL EXERCISER AND ENTERTAINMENT DEVICE

(76) Inventor: Alberto Domenge, Fuante de las Aguilas #194, Tecamachalco, Edo de Mex (MX) 53950

( * ) Notice: Subject to any disclaimer, the term of this patent is extended or adjusted under 35 U.S.C. 154(b) by 130 days.

(21) Appl. No.: 11/038,079

(22) Filed: Jan. 21, 2005

(65) Prior Publication Data

US 2006/0166795 A1 Jul. 27, 2006

(51) Int. Cl.
*A63B 21/22* (2006.01)
*A63B 23/00* (2006.01)

(52) U.S. Cl. ..... 482/110; 482/148

(58) Field of Classification Search ..... 482/110, 482/115, 118, 121–126, 148; 446/266; D21/466
See application file for complete search history.

(56) References Cited

U.S. PATENT DOCUMENTS 1,858,145 A * 5/1932 Felardo ..... 446/266
2,991,585 A * 7/1961 Drees ..... 446/266
3,672,093 A * 6/1972 Meek, Sr. ..... 446/266
3,693,286 A * 9/1972 Marcotti ..... 446/266
4,043,553 A 8/1977 Suarez
4,513,963 A 4/1985 Nelson et al.
4,714,946 A 12/1987 Bajgert et al.
4,787,623 A * 11/1988 Cedar ..... 482/81
D309,475 S * 7/1990 Salehzadeh et al. ..... D21/466
D337,621 S * 7/1993 Wong ..... D21/466
6,099,444 A 8/2000 Domenge
6,179,758 B1 1/2001 Domenge
6,413,099 B2 * 7/2002 Rainey ..... 434/191
6,488,613 B1 * 12/2002 Domenge ..... 482/110
6,500,102 B1 12/2002 Domenge
6,776,742 B2 * 8/2004 Domenge ..... 482/110

* cited by examiner

*Primary Examiner*—Fenn C Mathew
(74) *Attorney, Agent, or Firm*—Greenblum & Bernstein, P.L.C.

(57) ABSTRACT

The inertial exerciser and entertainment device includes a central axle on which is mounted pair of pendulums. Each pendulum includes an elongated pendulum rod, a spherical weight provided on one end of the pendulum rod, and an eyelet provided on the other end. The pendulum rods and the spherical weights of the exerciser are configured such that when the pendulums are mounted on the common axle, side by side, the spherical weights are aligned and are configured to oscillate and collide in the same plane.

2 Claims, 19 Drawing Sheets

INERTIAL EXERCISER AND ENTERTAINMENT DEVICE

BACKGROUND OF THE INVENTION

1. Field of the Invention

The present invention relates to an improved inertial exerciser and entertainment device which uses inertia to amplify exercise performed with the device.

2. Description of Background Information

Some conventional inertial exercisers, such as the exercisers disclosed in U.S. Pat. Nos. 4,714,946; 4,513,963; and No. 4,043,553; include eccentric weights. For example, U.S. Pat. No. 4,714,946 discloses an exerciser including a disk provided with two opposed handles. U.S. Pat. No. 4,513,963 discloses an exerciser including a tubular member having bearings provided within the tubular member. U.S. Pat. No. 4,043,553 discloses an exerciser including a pair of hand grips rotatably secured to an eccentrically weighted cross shaft.

Applicant's U.S. Pat. No. 6,488,613, the contents of which are hereby incorporated by reference, discloses an inertial exerciser device including first and second rotatably mounted weights, a chamber that at least partially encloses the weight system, and a grip mechanism for the user to grip the exerciser. The inertial exerciser device includes a spigot and yoke system to allow the spherical weights of the pendulums to rotate in the same plane. The method of exercising with this device is theoretically quite satisfactory. However, this exercise device may have the disadvantage that it is difficult to provide an equal mass for the two pendulums, as they have different shapes. Further, as a straight rod is rigidly connected to the spigot, the point of attachment of the rod to the spigot is subjected to excessive torsion forces, reflected in Lissajous lines, while in use. These excessive torsion forces may tend to induce material fatigue that will debilitate the pendulum's structural resistance, particularly if the elements are formed of molded plastic material, such as, for example, polyethylene. Additionally, since the pendulums of U.S. Pat. No. 6,488,613 are not exactly alike, they must be produced by two different manufacturing processes. Thus, manufacture of this device does not produce economies of scale. Further, in the case in which plastic material is used, two different molds must be used, which produces higher fixed costs and shorter production runs. Another consideration is that it is more aesthetically pleasing to provide a matched set of pendulums, since the pleasant appearance of a product is important for marketing and in the market place. Additionally, elimination of the circular cover would provide a lighter and more economical device to produce.

Applicant's U.S. Pat. No. 6,776,742 discloses a handheld exerciser including a handle to be gripped by a user, and at least two weights which are one of freely rotatably mounted and freely orbitally mounted about an axis passing through the handle.

SUMMARY OF THE INVENTION

To solve the above problems, the present invention provides an improved inertial exerciser and entertainment device which is lighter in weight, which is more economical to produce, and which is more attractive in appearance.

An aspect of the present invention includes an inertial exerciser including a central axle, the central axle extending in a longitudinal direction defining an axis of rotation; a handle; a first pendulum rotatably mounted on the central axle, the first pendulum including a pendulum rod having a first end and a second end, the second end of the first pendulum rod including a first eyelet and a first eyelet hole therethrough configured to receive the central axle, the first eyelet defining a first plane, transverse to the axis of rotation; a first weight provided on the first end of the first pendulum rod, the first weight including a center of mass defining a second plane transverse to the axis of rotation and spaced from the first plane; a second pendulum rotatably mounted on the central axle, the second pendulum including a pendulum rod having a first end and a second end, the second end of the second pendulum rod including a second eyelet and a second eyelet hole therethrough configured to receive the central axle, the second eyelet defining a third plane, transverse to the axis of rotation; and a second weight provided on the first end of the second pendulum rod, the second weight including a center of mass defining a fourth plane transverse to the axis of rotation and spaced from the third plane; wherein the center of mass of the first weight and the center of mass of the second weight are aligned to oscillate in one plane.

In a further aspect of the present invention, the handle is mounted on the central axle, the first pendulum being provided on the central axle between the handle and the second pendulum. The inertial exerciser may further include a curved portion on the first pendulum rod; and a curved portion on the second pendulum rod. Further, the first weight is provided eccentrically on the first pendulum rod and the second weight is provided eccentrically on the second pendulum rod. Additionally, the first weight is formed unitarily and in one piece with the first pendulum rod, and the second weight is formed unitarily and in one piece with the second pendulum rod.

In a further aspect of the present invention, the first weight is mounted on the first pendulum rod, and the second weight is mounted on the second pendulum rod. Further, the exerciser may include a plurality of attachment holes provided along the first end of the first pendulum rod; a mounting device to mount the first weight on the first pendulum rod via any one of the plurality of attachment holes along the first pendulum rod; a plurality of attachment holes provided along the first end of the second pendulum rod; and a mounting device to mount the second weight on the second pendulum rod via any one of the plurality of attachment holes along the second pendulum rod. The exerciser may include a hole provided through the first weight to mount the first weight on the first pendulum rod; and a hole provided through the second weight to mount the second weight on the second pendulum rod. Further, the hole in the first weight is provided eccentrically in the first weight and the hole in the second weight is provided eccentrically in the second weight.

A further aspect of the present invention provides an inertial exerciser including a central axle, the central axle extending in a longitudinal direction defining an axis of rotation; a handle; a first pendulum rotatably mounted on the central axle, the first pendulum including at least a first pendulum rod having a first end and a second end, the second end of the first pendulum rod including a first eyelet and a first eyelet hole therethrough configured to receive the central axle; a first weight provided on the first end of the first pendulum rod; a second pendulum rotatably mounted on the central axle, the second pendulum including a pair of second pendulum rods, each second pendulum rod having a first end and a second end, each the second end of the second pendulum rod including a second eyelet and a second eyelet hole therethrough configured to receive the central axle; and a second weight provided on the first ends of the second pendulum rods; wherein the first pendulum rod is mounted between the second pendulum rods such that the center of mass of the first weight and the center of mass of the second weight are aligned to oscillate in one plane. Further, the first pendulum includes a pair of first pendulum rods, each first pendulum rod having a first end and a second end, each the second end of the first pendulum rod including a first eyelet and a first eyelet hole therethrough configured to receive the central axle; wherein one of the first pendulum rods is mounted between the second pendulum rods and one of the second pendulum rods is mounted between the first pendulum rods such that the center of mass of the first weight and the center of mass of the second weight are aligned to oscillate in one plane.

A further aspect of the present invention provides an inertial exerciser including an elongated bar member having a first end and a second end; a handle mounted on the first end of the bar member; a handle mounted on the second end of the bar member; a central axle projecting from the bar member between the first and second ends, the central axle defining an axis of rotation; a first pendulum rotatably mounted on the central axle, the first pendulum including a pendulum rod having a first end and a second end, the second end of the first pendulum rod including a first eyelet and a first eyelet hole therethrough configured to receive the central axle, the first eyelet defining a first plane, transverse to the axis of rotation; a first weight provided on the first end of the first pendulum rod, the first weight including a center of mass defining a second plane transverse to the axis of rotation and spaced from the first plane; a second pendulum rotatably mounted on the central axle, the second pendulum including a pendulum rod having a first end and a second end, the second end of the second pendulum rod including a second eyelet and a second eyelet hole therethrough configured to receive the central axle, the second eyelet defining a third plane, transverse to the axis of rotation; and a second weight provided on the first end of the second pendulum rod, the second weight including a center of mass defining a fourth plane transverse to the axis of rotation and spaced from the third plane; wherein the center of mass of the first weight and the center of mass of the second weight are aligned to oscillate in one plane.

BRIEF DESCRIPTION OF THE DRAWINGS

The above and the other objects, features and advantages of the present invention will be made apparent from the following description of the preferred embodiments, given as non-limiting examples, with references to the accompanying drawings, in which.

DETAILED DESCRIPTION OF THE INVENTION

The particulars shown herein are by way of example and for purposes of illustrative discussion of the embodiments of the present invention only and are presented in the cause of providing what is believed to be the most useful and readily understood description of the principles and conceptual aspects of the present invention. In this regard, no attempt is made to show structural details of the present invention in more detail than is necessary for the fundamental understanding of the present invention, the description is taken with the drawings making apparent to those skilled in the art how the forms of the present invention may be embodied in practice.

Figure 1:
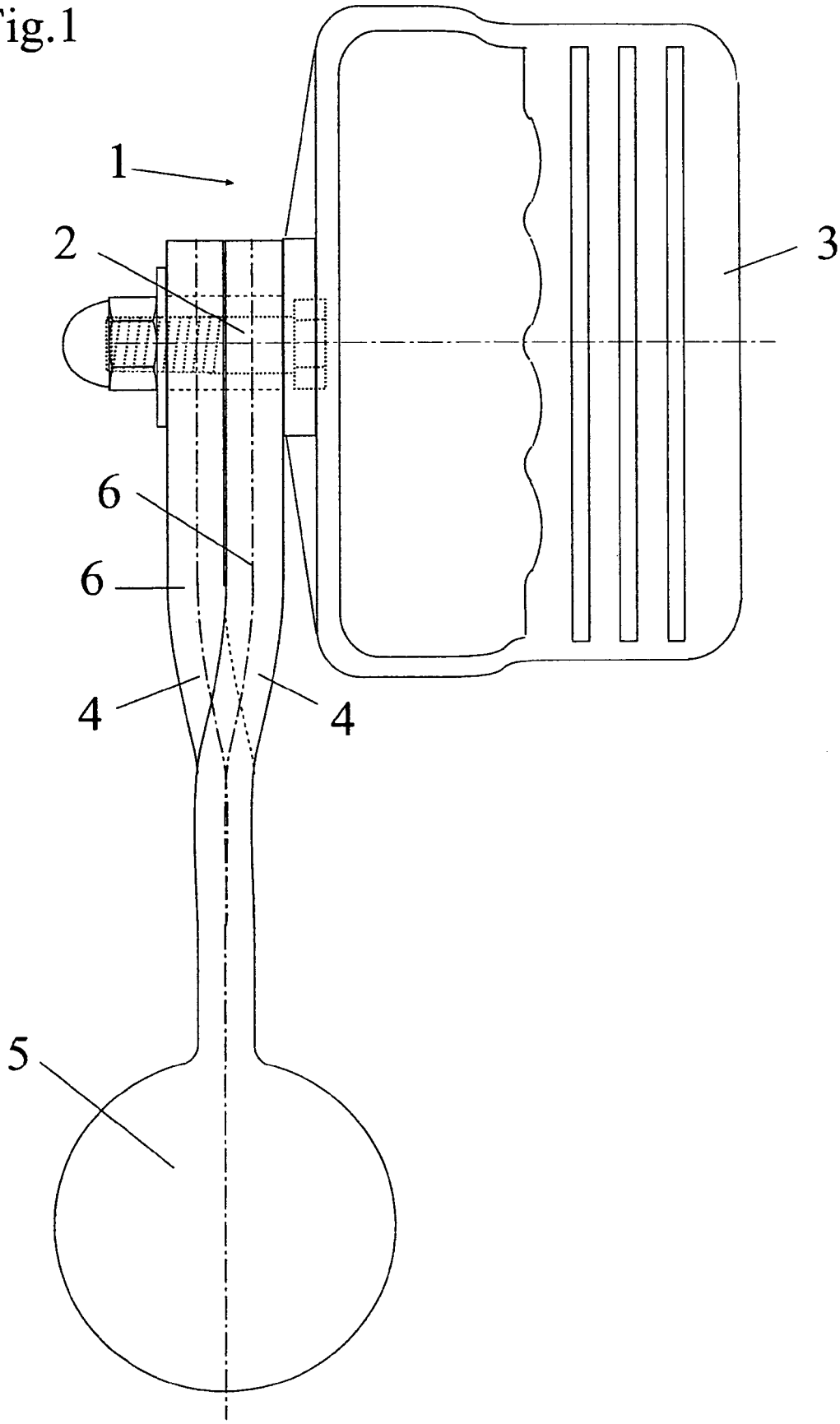
FIG. 1 is a side elevational view of the inertial exerciser and entertainment device of a first embodiment of the present invention showing the pendulum hubs mounted side by side on their common axle, the curved shape of the pendulum rods and the spherical weights attached to the rods.
Figure 2:
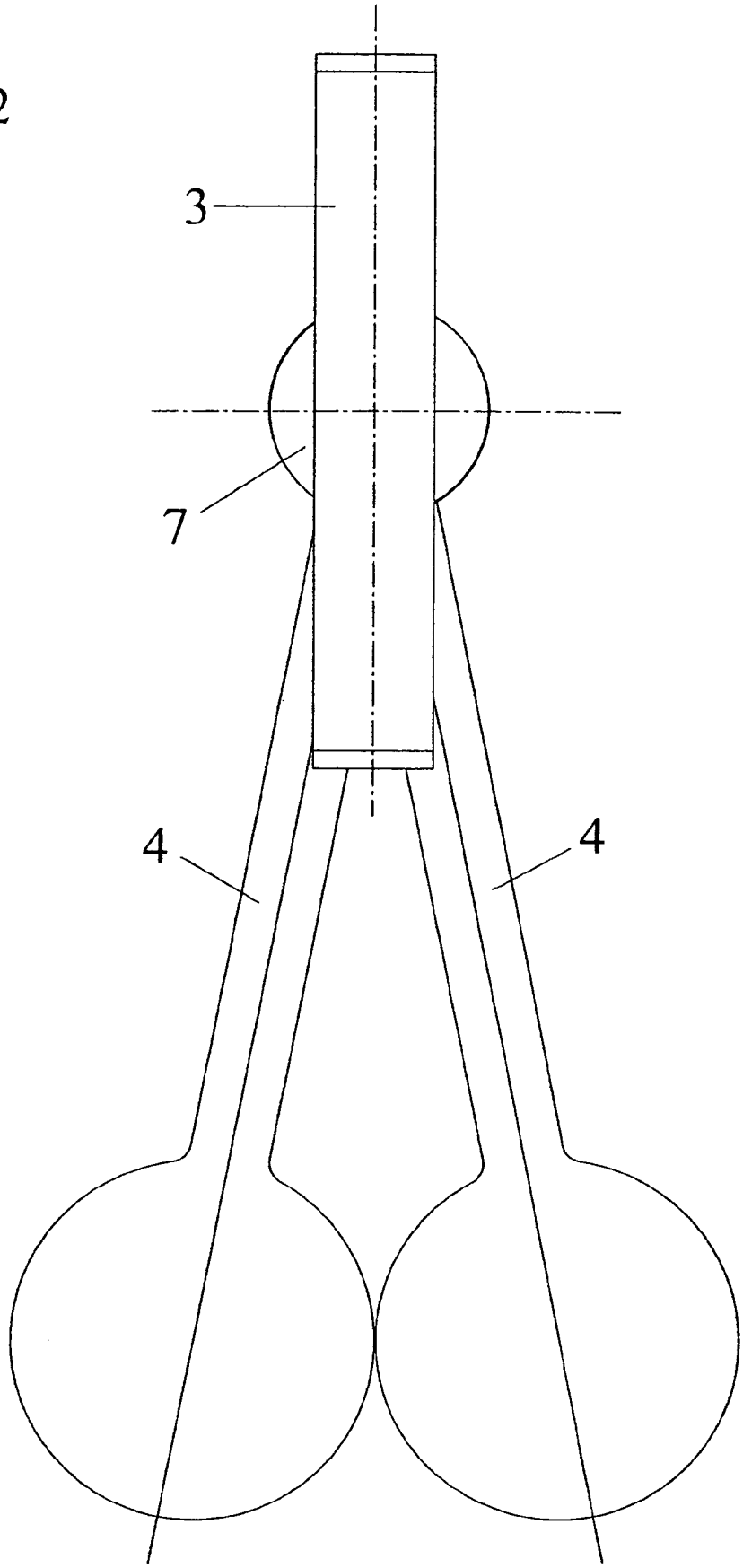
FIG. 2 is a bottom view of the inertial exerciser and entertainment device of the embodiment of FIG. 1.
Figure 5A:
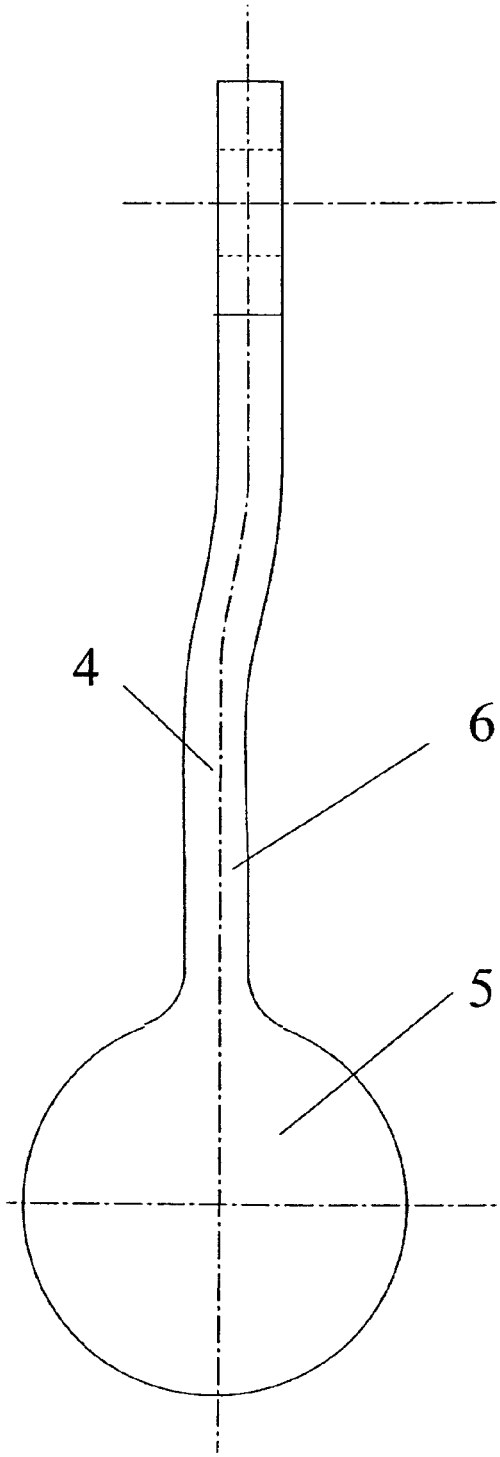
FIG. 5*a* side view of a pendulum of the inertial exerciser and entertainment device of the embodiment of FIG. 1, showing the curved shaped of the pendulum rod, only one pendulum is illustrated since both pendulums are identical.
Figure 5B:
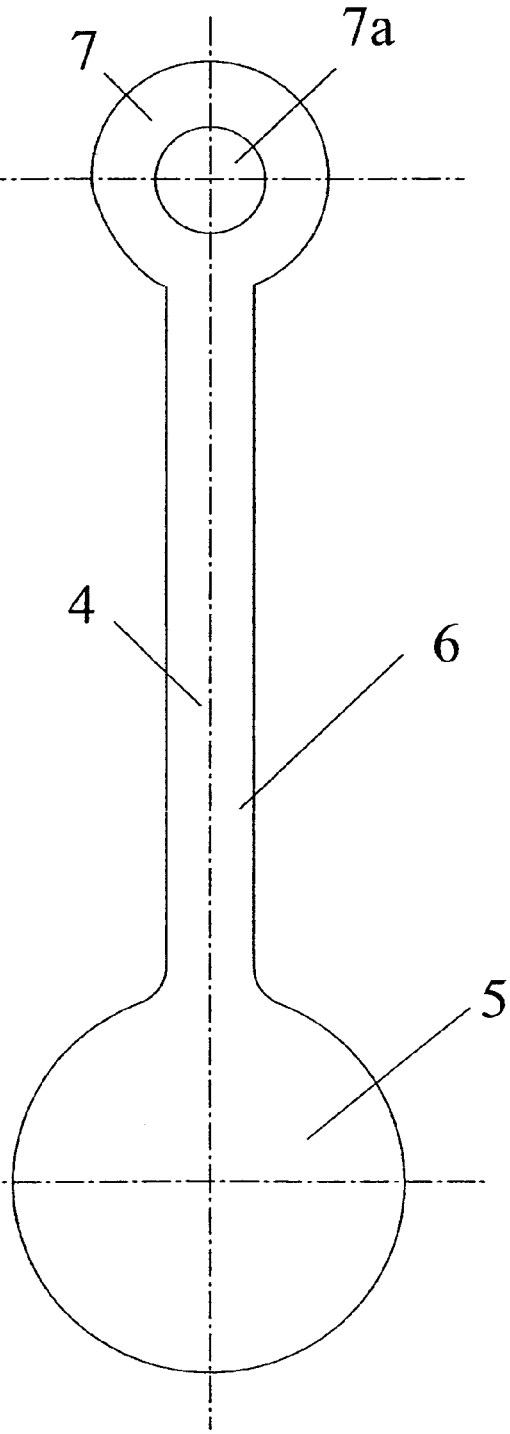
FIG. 5*b* is a top view of the pendulum of FIG. 5*a;*

FIG. 1 illustrates a first embodiment of the improved inertial exerciser and entertainment device 1 of the present invention. Exerciser 1 includes a central axle 2 on which is mounted a handle 3, and a pair of pendulums 4. As also shown in FIGS. 5*a* and 5*b*, each pendulum 4 includes an elongated pendulum rod 6, a spherical weight 5 provided on one end of the pendulum rod 6, and an eyelet 7 provided on the other end of the pendulum rod 6, the eyelet 7 having a hole 7*a* therethrough. The eyelet 7 and eyelet hole 7*a* are configured to receive the axle 2 therethrough. The spherical weights 5 and the pendulum rods 6 may be made of any suitable material such as, for example, metal, plastic, or a composite material.

As shown particularly in FIGS. 1 and 5, in the first embodiment of the present invention, the rods 6 of the pendulums 4 are provided with a curved shape so that when the pendulums 4 are mounted on the common axle 2, side by side, the spherical weights 5 are aligned and are thus capable of oscillating and colliding in the same plane. As shown in FIG. 1, the pendulum 4 hubs are mounted side by side on the common axle 2.

Figures 3, 4:
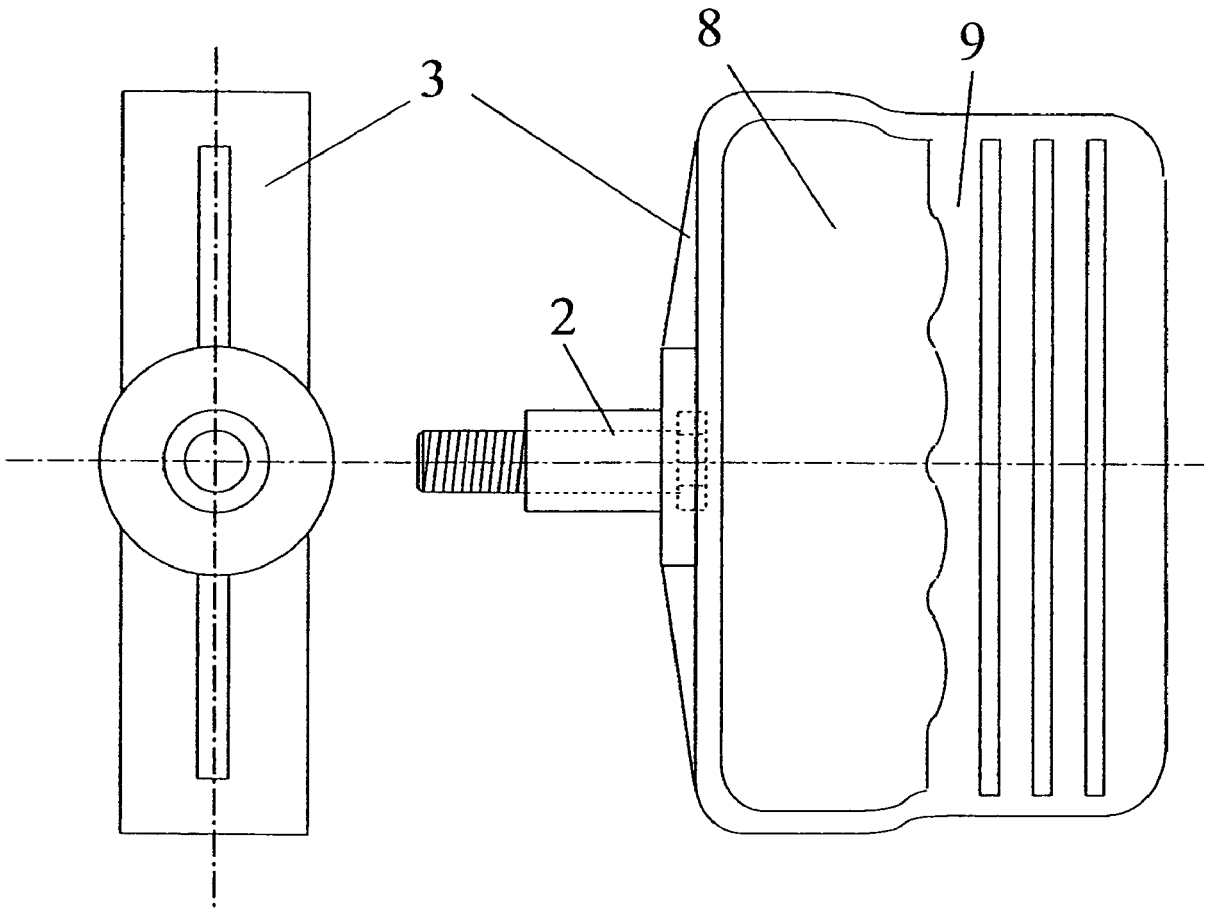
FIG. 3 is a top view of the handle of the inertial exerciser and entertainment device of the embodiment of FIG. 1, showing the axle on which the pendulums are rotatably mounted.
FIG. 4 is a side view of the handle of the inertial exerciser and entertainment device of the embodiment of FIG. 1.

As shown in FIGS. 1, 3, and 4, the handle 3 includes a space 8 configured to receive a user's hand, and adjacent gripping members 9 to improve the user's grip on the device and to prevent slipping. The handle 3 further includes the axle 2 extending therefrom and rigidly attached thereto, which receives the eyelet holes 7*a* on the pendulums 4. The handle 3 is configured so that the pendulums 4 with the weights 5 thereon freely rotate about the axle 2. The handle 3 may loosely rotate. The handle 3 and the axle 2 may be made of any suitable material such as, for example, metal, plastic, or a composite material. In order to dampen the noise produced by the collision of the weights 5 or spherical balls, the weights 5 or balls may be made out of any suitable highly resilient material such as, for example, polybutadiene or silicon compounds.

As shown in FIGS. 5*a* and 5*b*, the weights 5 may be formed unitarily and in one piece with the pendulum rod 6. For example, the pendulum 4 may be formed by molding the pendulum rod 6 with the weight 5 thereon.

Figure 6A:
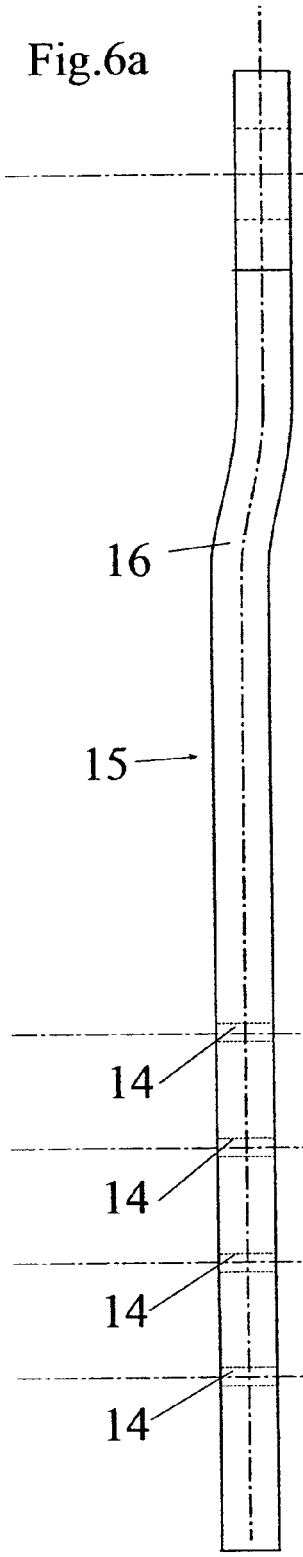
FIG. 6*a* is a side view of a pendulum of an inertial exerciser and entertainment device of an alternative to the embodiment of FIG. 5*a*, showing the curved shape of the pendulum rod, only one pendulum is illustrated since both pendulums are identical.
Figure 6B:
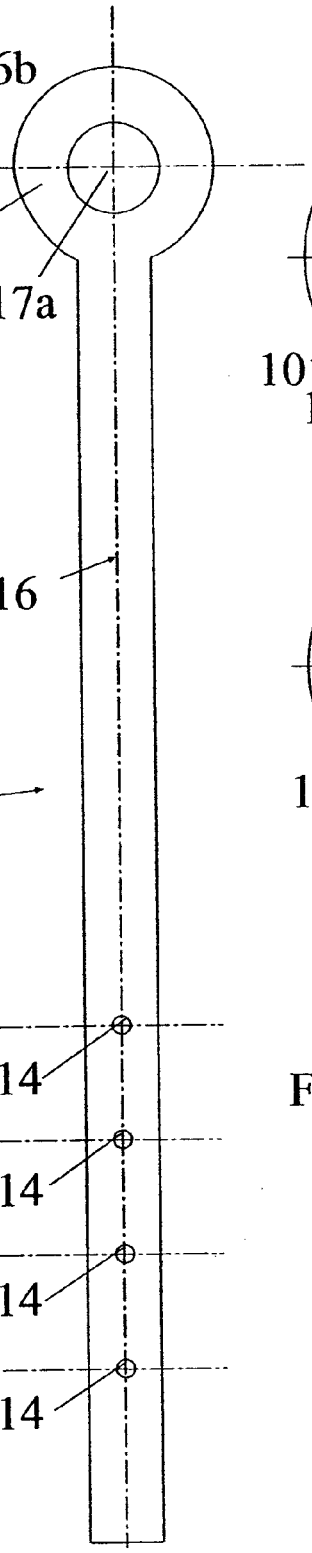
FIG. 6*b* is top view of the pendulum of FIG. 6*a;*
Figure 7:
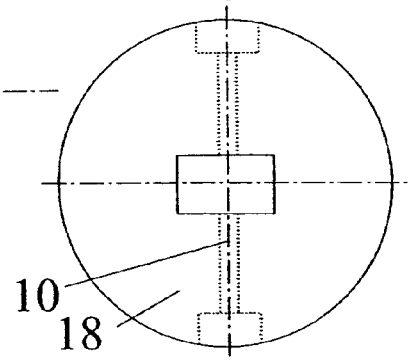
FIG. 7 is a top view of a spherical weight of the inertial exerciser and entertainment device of the embodiment of FIG. 6*a;*
Figure 8:
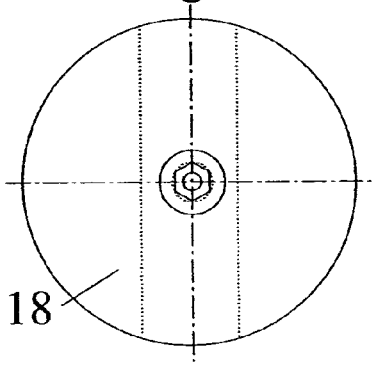
FIG. 8 is a front view of the spherical weight of FIG. 7, showing the fixing screw assembly.
Figure 9:
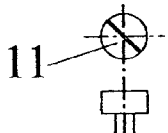
FIG. 9 is a top view of the fixing screw head for the spherical weight of FIG. 7.
Figure 10:
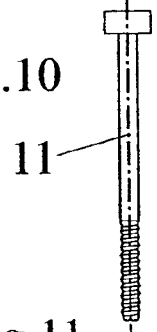
FIG. 10 is a side view of the fixing screw of FIG. 9.
Figure 11:
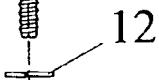
FIG. 11 shows a washer in the fixing screw assembly of FIG. 8.
Figure 12:
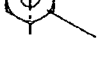
FIG. 12 shows a bolt in the fixing screw assembly of FIG. 8.
Figure 13:
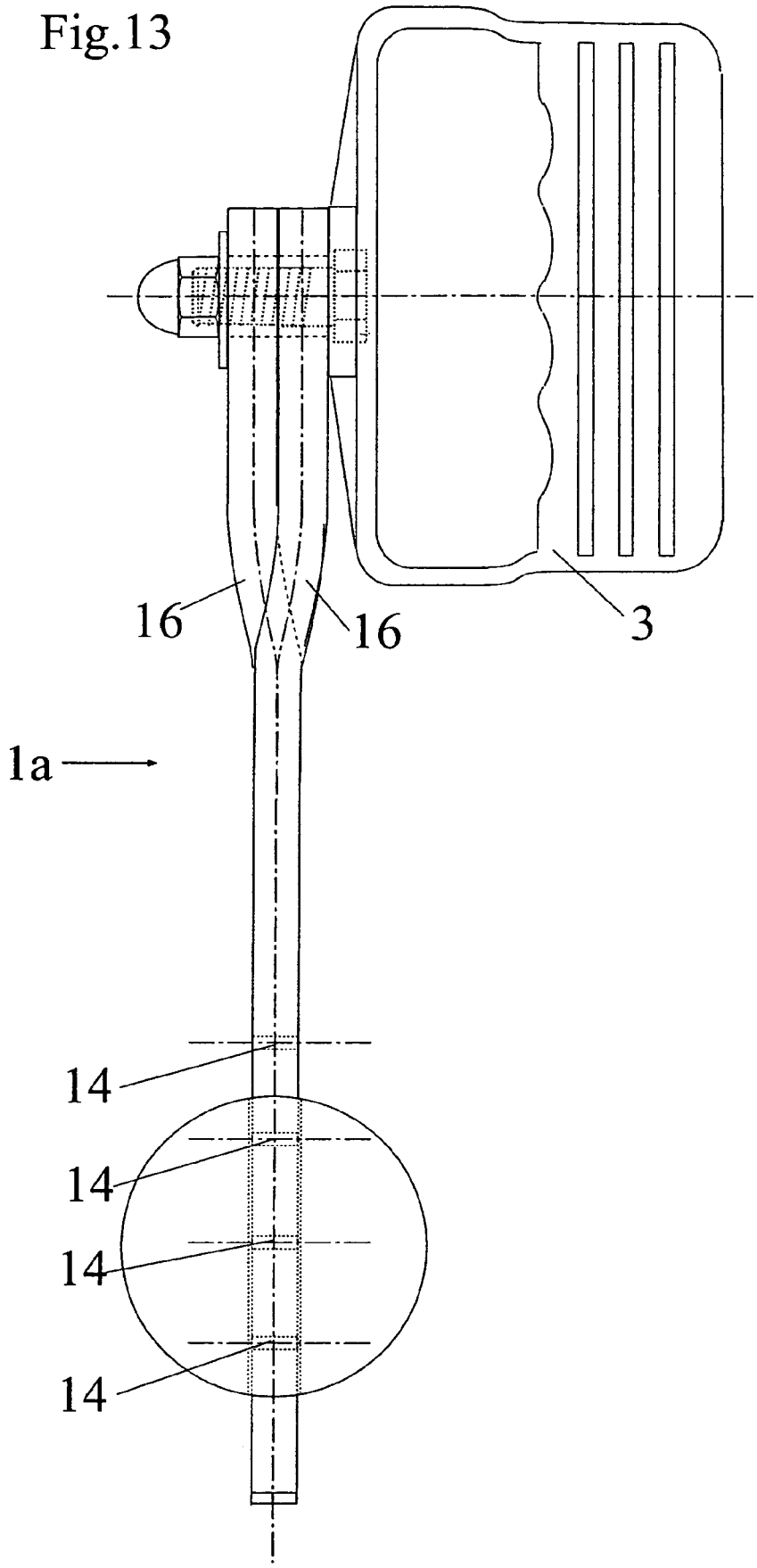
FIG. 13 is a side elevational view of the inertial exerciser and entertainment device of the alternative embodiment of FIG. 6*a*, showing the assembled device; showing the second straight end of the pendulum provided with equidistant cylindrical through holes through which the fixing screw of the spherical weight is passed to fix the spherical weight at a chosen length from the axle.
Figure 14:
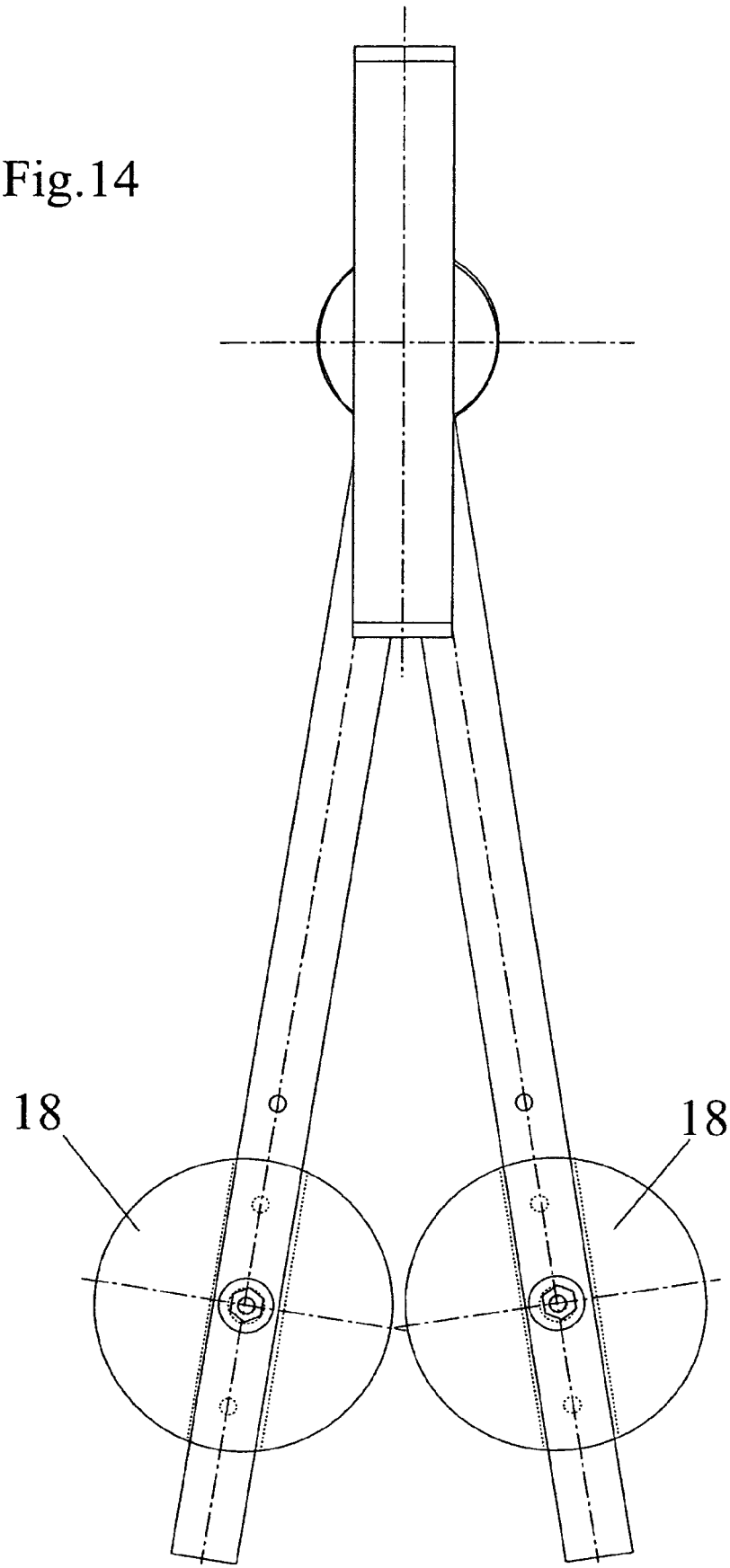
FIG. 14 is a bottom view of the inertial exerciser and entertainment device of the alternative embodiment of FIG. 13.

An alternative embodiment of the inertial exerciser and entertainment device 1*a* is shown in FIGS. 6*a*, 6*b*, and 7-14. In this alternative embodiment, as shown in FIGS. 6*a* and 6*b*, each weight 18 may be mounted on the end of a pendulum rod 16 of pendulum 15. Each weight 18 may be mounted on the end of a pendulum rod 16 in any suitable manner such as, for example by a bolt, or welding. As shown in FIGS. 7-12, in this alternative embodiment, each spherical weight 18 is provided with a central diametric through hole 10 having a rectangular cross section and through which the fixing screw 11 is introduced. A fixing screw assembly includes the fixing screw 11, a washer 12, and a nut 13. As shown in FIGS. 6*a* and 6*b*, in this alternative embodiment, each pendulum rod 16 includes a plurality of holes 14 at one end thereof and an eyelet 17 and eyelet hole 17*a*. The fixing screw assembly is provided to attach a weight 18 to a respective pendulum rod 16 via one of the plurality of holes 14. The user may choose one of the plurality of holes 14 to which the weight 18 will be attached, in order to provide the desired resistance. In this manner, the inertial exerciser and entertainment device of the present invention is adjustable. Accordingly, the user configures the device for a custom workout particularly suited to his or her particular needs. In this regard, by changing the distance of the weight from the axle, the inertia produced by the oscillating or rotating motion is increased or decreased proportionally.

Additionally, different pairs of weights having different masses, may be attached to the pendulum rods. In this manner, the exerciser may be further adapted to the user's requirements, level of training, strength, and expertise.

The operation of the inertial exerciser and entertainment device is as follows. Initially, a user grasps the handle 3 with a hand. Next, the user imparts to the device a movement which may be in any number of directions such as, for example, substantially vertical or horizontal, linear, or circular reciprocating motion. A substantially orbital or circular continuous motion can also be imparted to the exerciser, as well as to the various embodiments described herein. Depending on the motion imparted to the exerciser, the weights are caused to move with a circular reciprocating motion and eventually collide with one another at the end of each half cycle or moved together with a circular continuous motion. Accordingly, such motion gives the user of the exerciser a unique exercise experience which is different from that of conventional exercisers.

Figure 15:
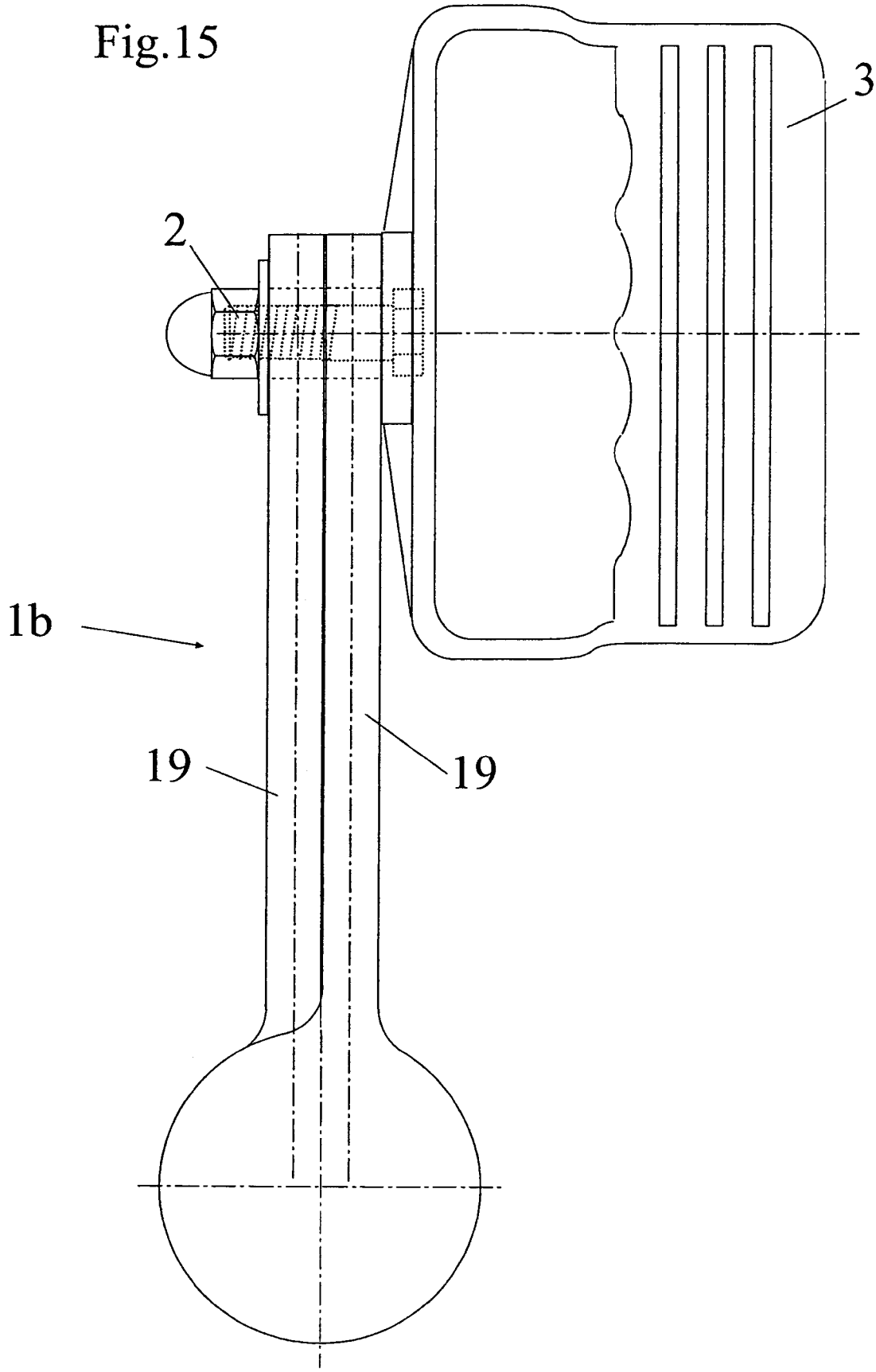
FIG. 15 is a side elevational view of an inertial exerciser and entertainment device of a second embodiment of the present invention, showing the pendulums provided with a straight pendulum rod and eccentrically mounted weights.
Figure 16:
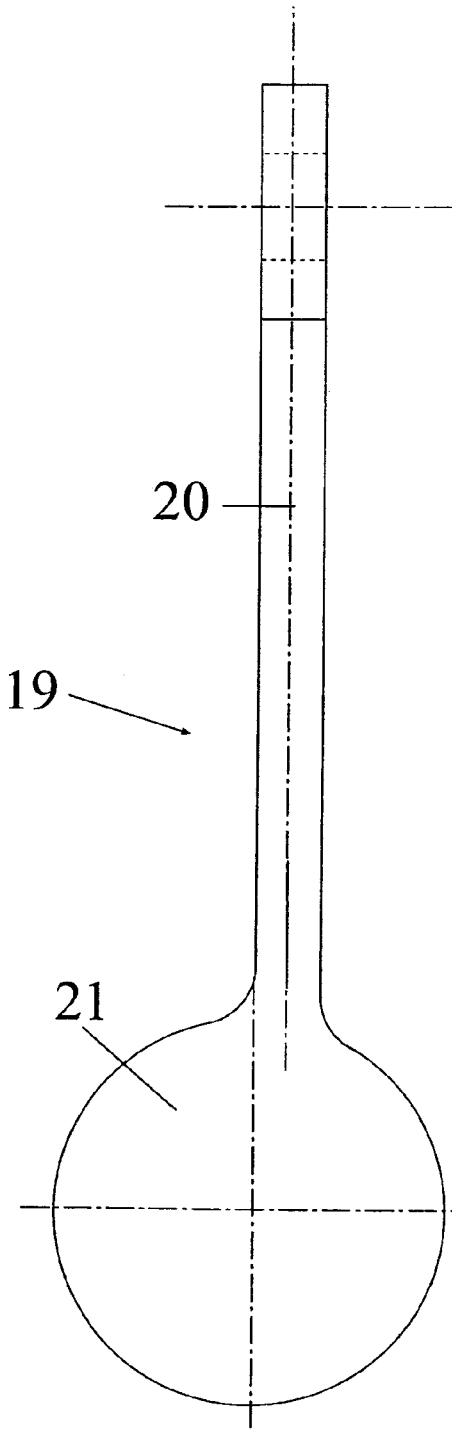
FIG. 16 is a side view of a pendulum of the inertial exerciser and entertainment device of the embodiment of FIG. 15, showing the single straight section of pendulum, and its eccentrically rigidly connected weight.
Figure 17:
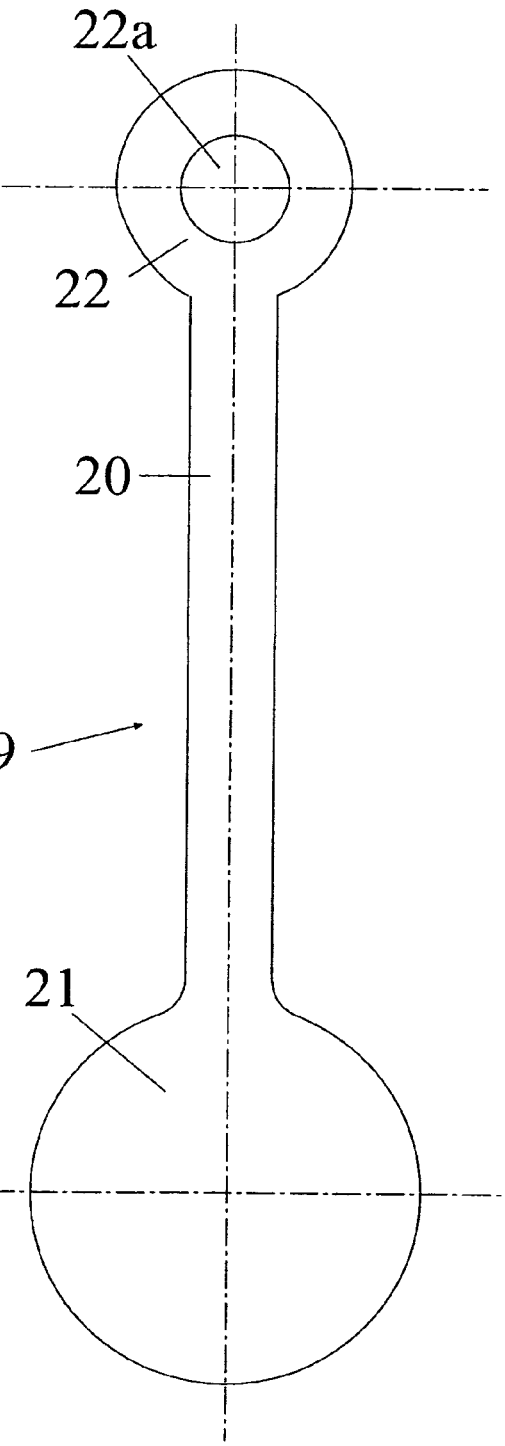
FIG. 17 is top view of the pendulum of FIG. 16.

FIGS. 15-17 illustrate a second embodiment of the improved inertial exerciser and entertainment device 1*b* of the present invention. Exerciser 1*b* of the second embodiment includes a central axle 2 on which is mounted the handle 3, and a pair of pendulums 19. As shown in FIGS. 16 and 17, each pendulum 19 includes an elongated pendulum rod 20, a substantially spherical weight 21 provided on one end of the pendulum rod 20, and an eyelet 22 having an eyelet hole 22*a* therethrough.

As shown particularly in FIGS. 15-17, in the exerciser of the second embodiment, the pendulums 19 are alike. Further, each pendulum 19 includes an elongated pendulum rod 20 which is substantially straight. Each pendulum 19 includes a weight 21 mounted eccentrically thereon. When exerciser 1*b* is assembled, the pendulums 19 are rotatably mounted on the common axle 2, side by side. The weights 21 are rigidly and eccentrically connected to respective straight pendulum rod 20. As shown in FIG. 15, each weight 21 is somewhat displaced centrally toward the other weight 21. Accordingly, due to the eccentric mounting of the weights 21, the pendulums 19 are configured to rotate and collide in the same plane.

Additionally, as shown in FIGS. 22-26, the weights 21*a* provided eccentrically on the pendulum rods 20*a* may be attached by any suitable device such as, for example, by mounting a separately formed weight 21*a* onto the pendulum rod 20*a* by forming the weight 21 and the pendulum 21 unitarily and in one piece. In an alternative in which the weight 21*a* is mounted to the pendulum rod 20*a*, the pendulum rod 20*a* may include a plurality of holes 20*b* configured to receive a fixing screw assembly to mount the weight 21*a* onto the pendulum rod 20*a*. The weight 21*a* includes an off-center, asymmetrical through hole configured to receive the fixing screw assembly.

Further, in another alternative embodiment of eccentrically mounting the weights on respective pendulum rods, each substantially spherical weight may be provided with two parallel holes that allow sliding, positioning, and fixing the spherical weight at a particular distance from the center of the common rotational axis. This alternative also permits varying the ratio of the spherical weights.

Figure 18:
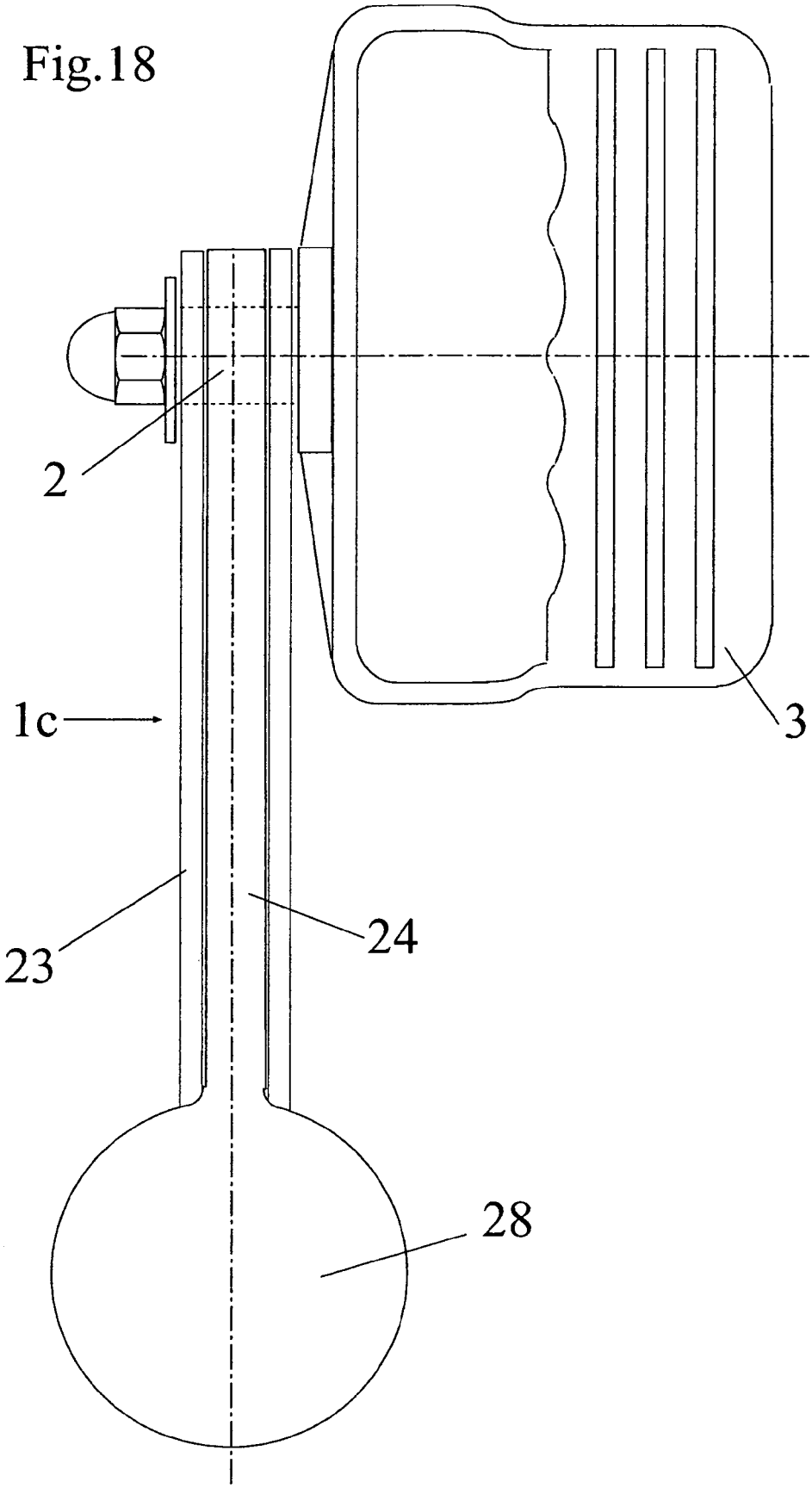
FIG. 18 is a side elevational view of an inertial exerciser and entertainment device of a third embodiment of the present invention.
Figure 19:
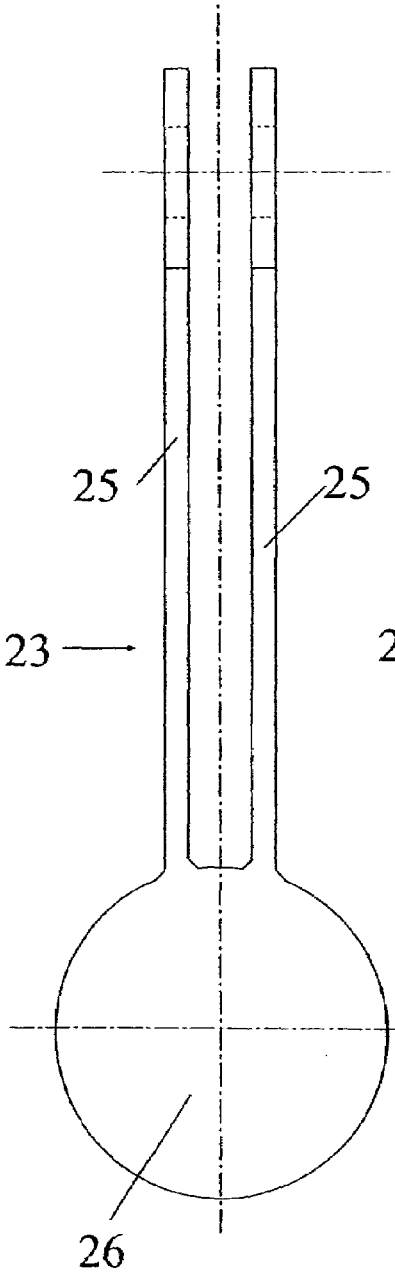
FIG. 19 is a side view of a first pendulum of the inertial exerciser and entertainment device of the embodiment of FIG. 18, showing its two straight and parallel rods rigidly connected to its corresponding centrally aligned spherical weight.
Figure 20:
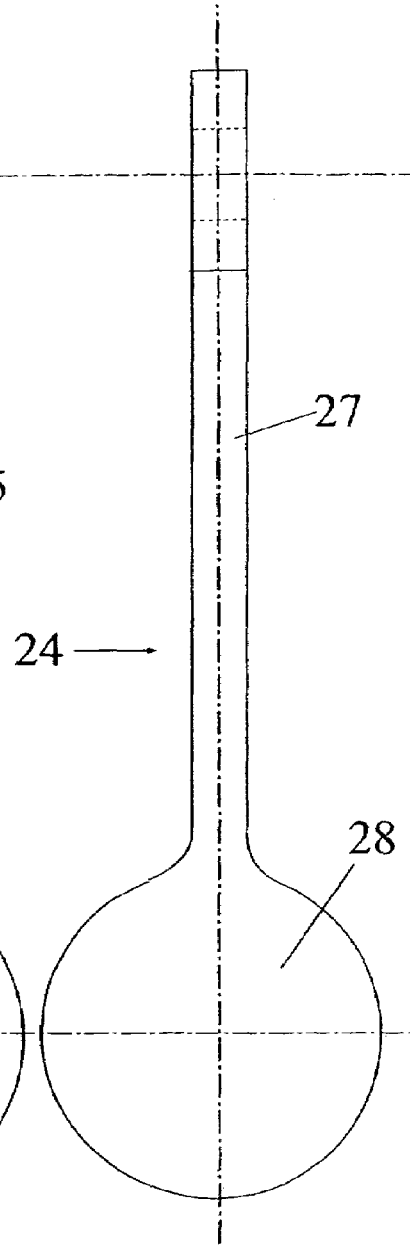
FIG. 20 is a side view of the central pendulum of the inertial exerciser and entertainment device of the embodiment of FIG. 18.
Figure 21:
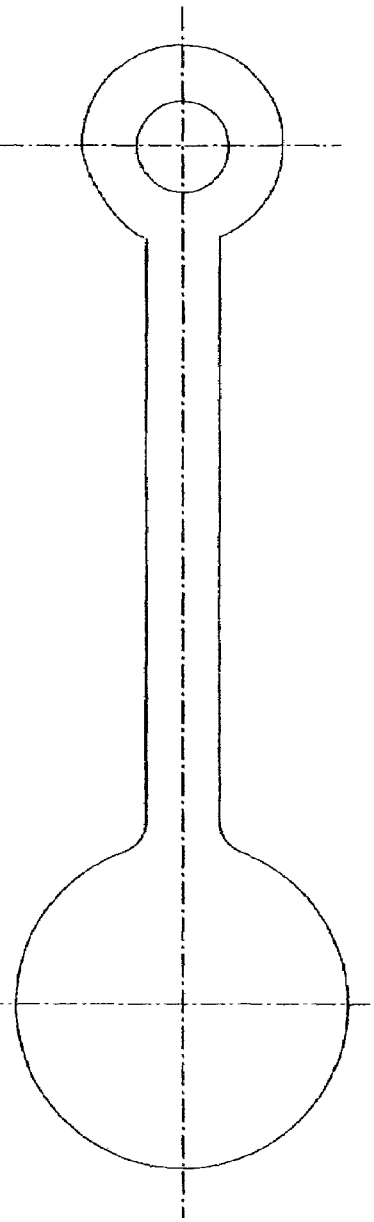
FIG. 21 is a top view of the first pendulum or of the central pendulum of the inertial exerciser and entertainment device of the embodiment of FIG. 18.
Figure 22:
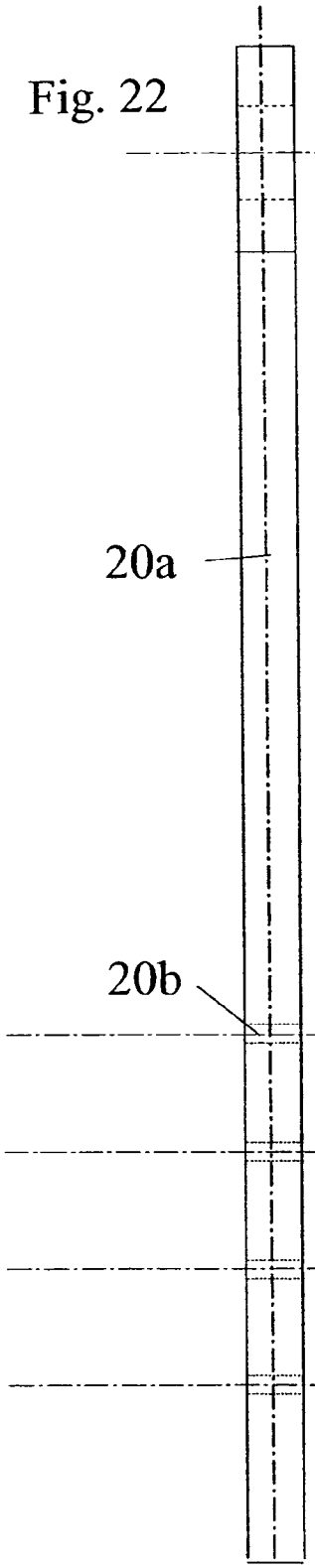
FIG. 22 is a side view of a pendulum of an inertial exerciser and entertainment device of an embodiment of the present invention, alternative to the embodiment of FIGS. 15-17.
Figure 23:
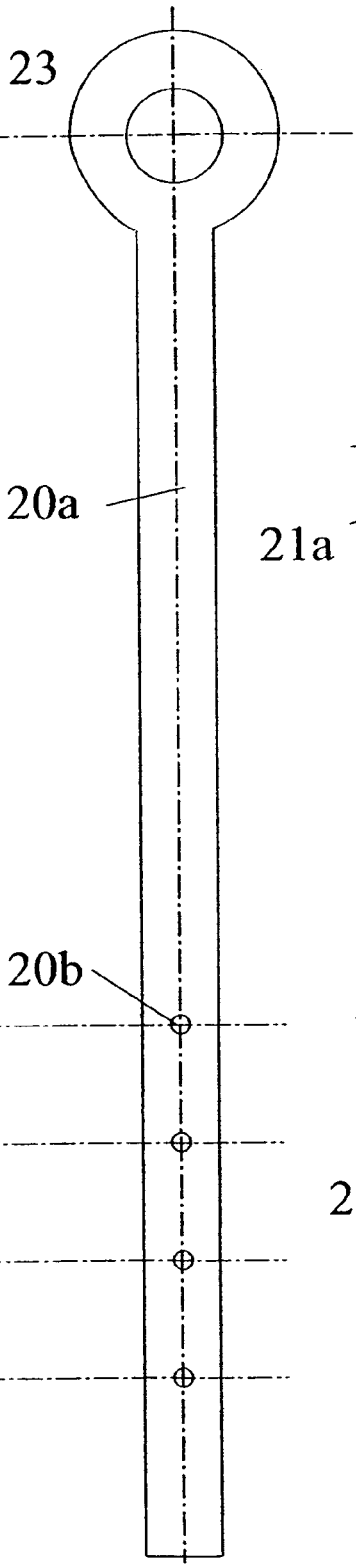
FIG. 23 is a front view of the pendulum of FIG. 22.
Figure 24:
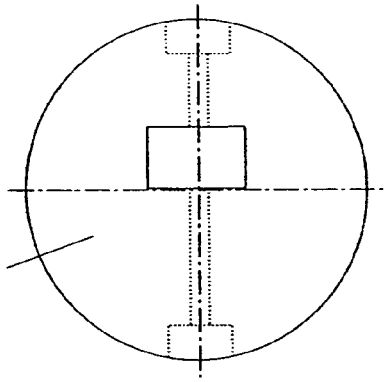
FIG. 24 is a top view of the spherical weight utilized with the straight pendulum of FIG. 22, showing an eccentric asymmetric rectangular cross section through hole, to insert the spherical weight in its corresponding straight open ended rod with a diametric through hole for receiving the fixing screw.
Figure 25:
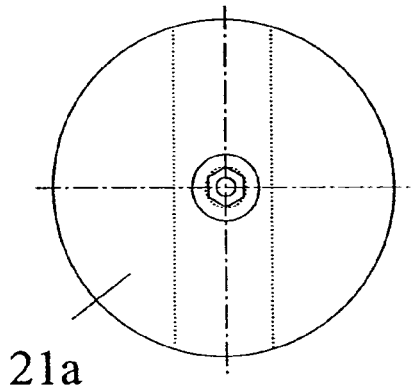
FIG. 25 is a front view of the spherical weight of FIG. 24 showing the fixing screw bolt.
Figure 26:
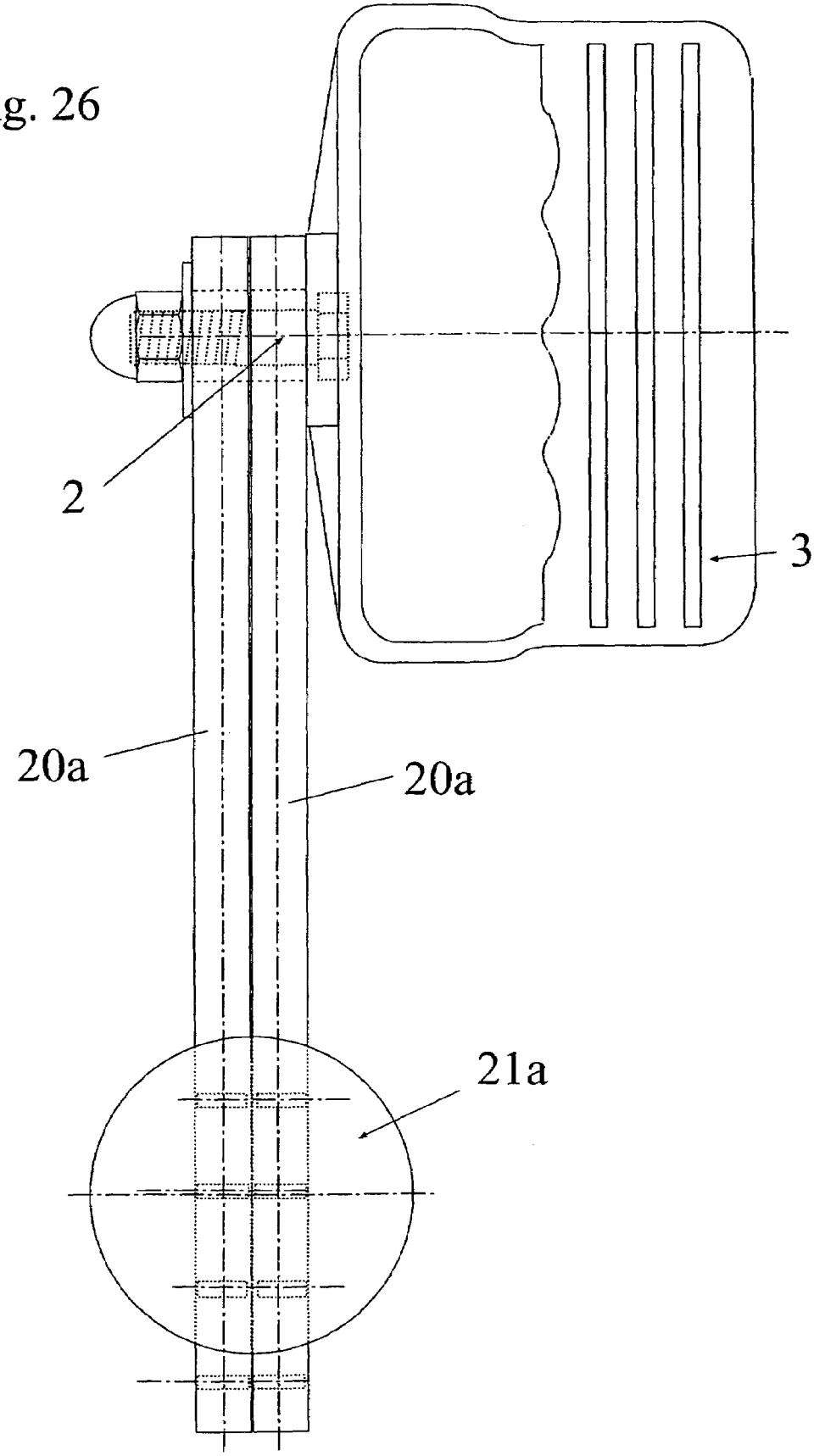
FIG. 26 is a side view of inertial exerciser and entertainment device of the alternative embodiment of FIG. 22 in which the pendulums have a single straight open ended section provided with equidistant cylindrical fixing holes, the spherical weights with eccentric through holes are shown eccentrically positioned on a corresponding straight pendulum, only one pendulum is shown since the second pendulum is identical to the first and is positioned behind the first pendulum.

FIGS. 18-21 illustrate a third embodiment of the improved inertial exerciser and entertainment device 1*c* of the present invention. Exerciser 1*c* of the third embodiment includes a central axle 2 on which is mounted the handle 3, a first pendulum 23, and a second pendulum 24. As shown in FIG. 19, the first pendulum 23 includes two straight and parallel rods 25 rigidly connected to a corresponding spherical weight 26, and an eyelet having an eyelet hole therethrough. Accordingly, in this embodiment, possible weak tension points where a curved section of the yoke was attached to the straight rod section in the device of my prior U.S. Pat. No. 6,488,613 are eliminated. As shown in FIG. 20, the second or central pendulum 24 includes a single straight pendulum rod 27 rigidly connected to a corresponding spherical weight 28, and an eyelet having an eyelet hole therethrough. As shown in FIG. 21, the top view of the first pendulum 23 and the top view of the second pendulum 24 are the same. The exerciser 1*c* of the third embodiment is assembled as shown in FIG. 18 such that the pendulum rod 27 of the second pendulum 24 is positioned between the pendulum rods 25 of the first pendulum 23. Accordingly, the weights 26, 28 are aligned and rotate in the same plane.

Figure 27:
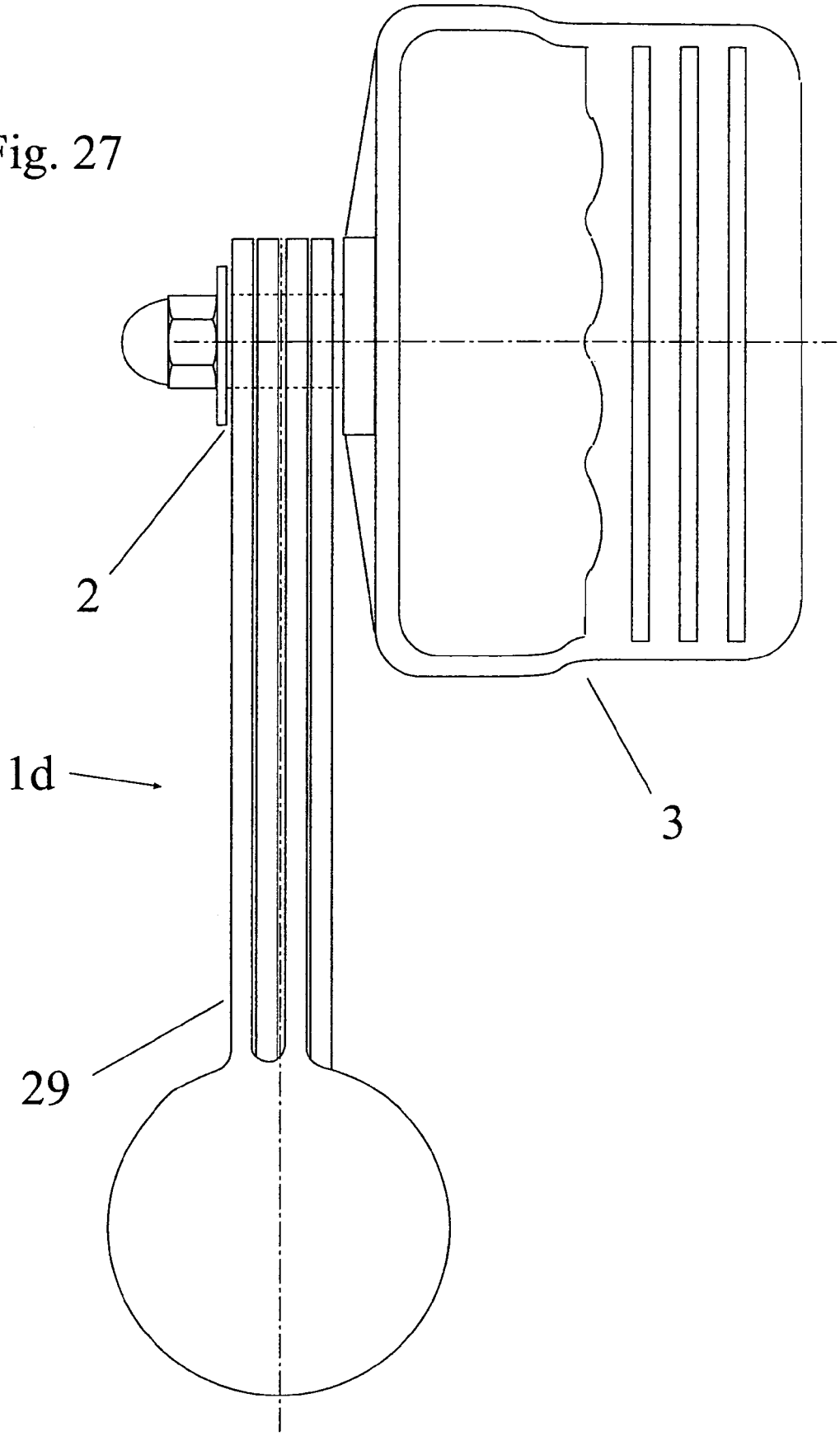
FIG. 27 is a side view of an exerciser and entertainment device of an embodiment of the present invention, alternative to the embodiment of FIGS. 18-21.
Figure 28:
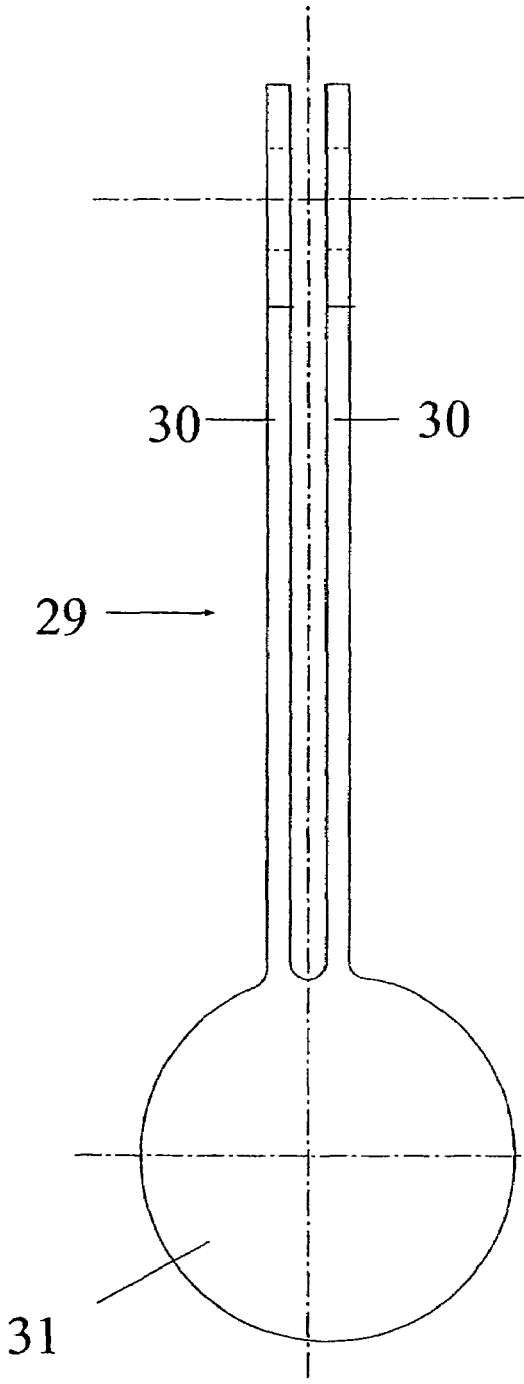
FIG. 28 is a front view of a pendulum of the exerciser and entertainment device of the alternative embodiment of FIG. 27, only one pendulum is shown since the pendulums are identical.
Figure 29:
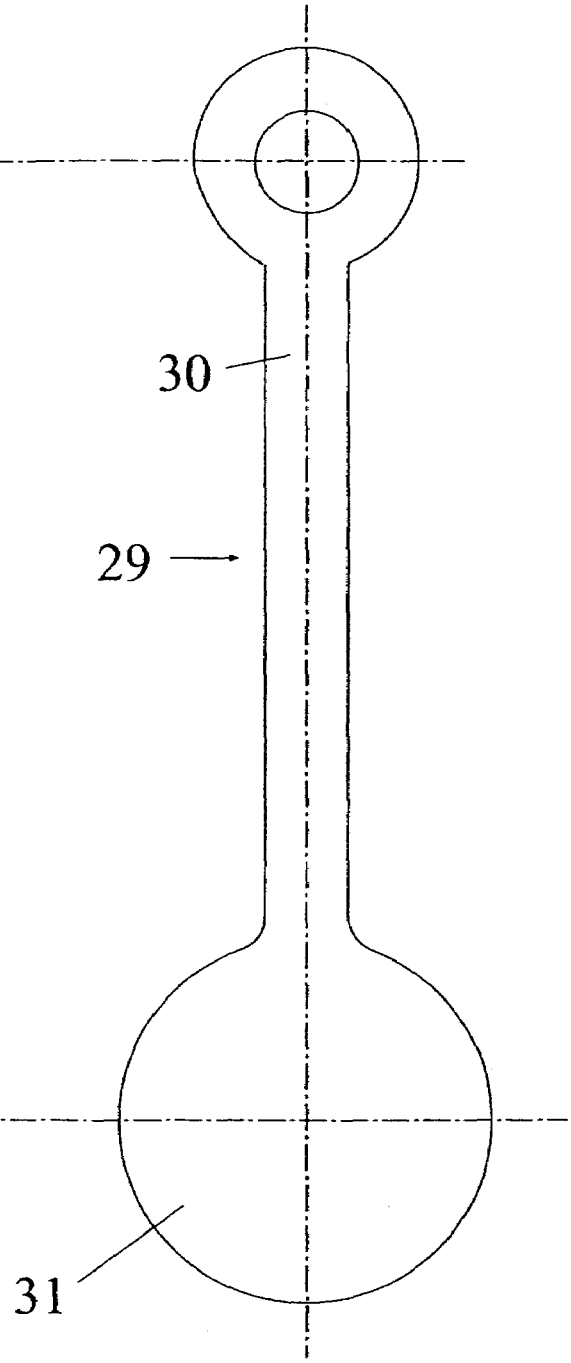
FIG. 29 is a top view of the pendulum of FIG. 28.

FIGS. 27-29 illustrate an alternative to the embodiment described in FIGS. 18-21. In the alternative embodiment shown in FIGS. 27-29, the exerciser 1*d* of the present invention includes a central axle 2 on which is mounted the handle 3, and first and second pendulums 29. The first and second pendulums 29 are identical, and thus only one is shown in FIGS. 28 and 29. As shown in FIGS. 28 and 29, each pendulum 29 includes two straight and parallel rods 30 rigidly connected to a corresponding spherical weight 31, and an eyelet having an eyelet hole therethrough. The exerciser 1*d* of the alternative embodiment is assembled as shown in FIG. 27 such that the pendulum rods 30 of first and second pendulums 29 are positioned in an alternating pattern and on a common axle 2 so that one of the pendulum rods 30 of each pendulum 29 is positioned between the pendulum rods 30 of the other pendulum 29. The handle 3 is rotatably mounted. Further, a weight 31 is eccentrically provided on each pendulum rod 30. Accordingly, the weights 31 are aligned and rotate in the same plane. Each weight 31 may be formed unitarily and in one piece with a respective pendulum rod 30.

Figure 30:
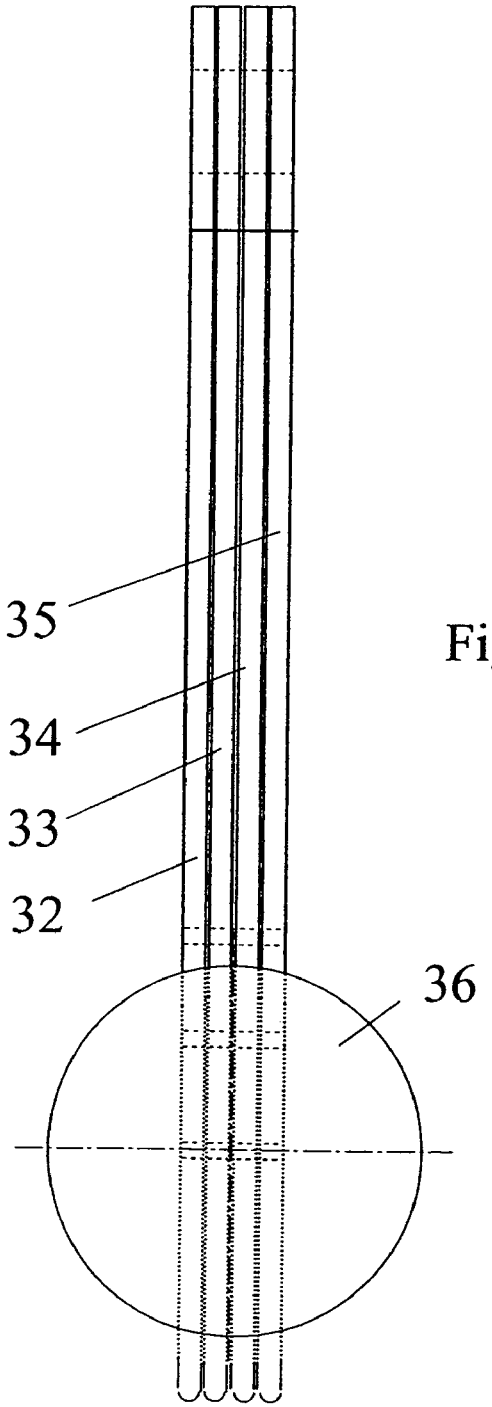
FIG. 30 is a side view of a pair of pendulums of an inertial exerciser and entertainment device of an alternative to the embodiment of FIGS. 27-29.
Figure 31:
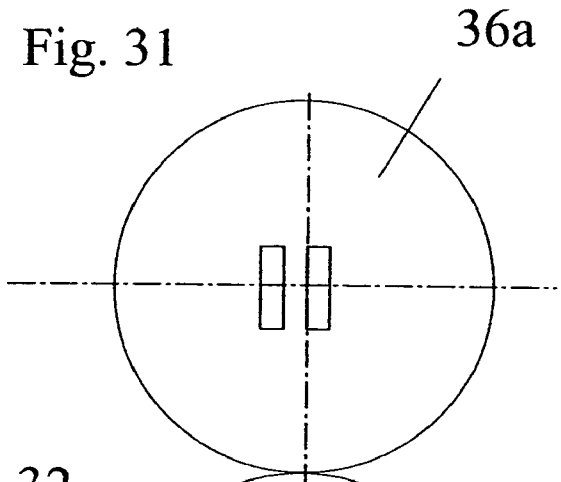
FIG. 31 is a top view of a first spherical weight of the pendulum shown in FIG. 30.
Figure 32:
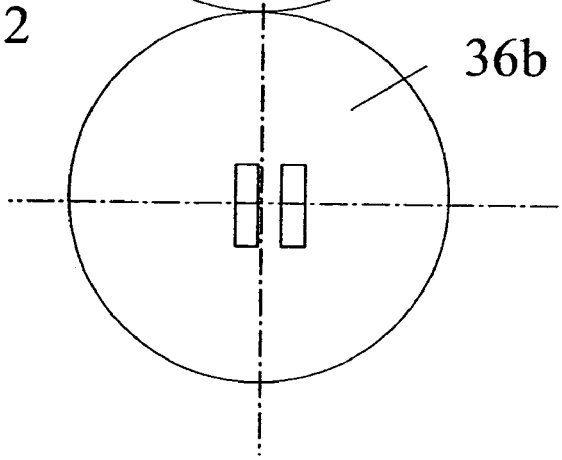
FIG. 32 is a top view of a second spherical weight of the pendulum shown in FIG. 30.
Figure 33:
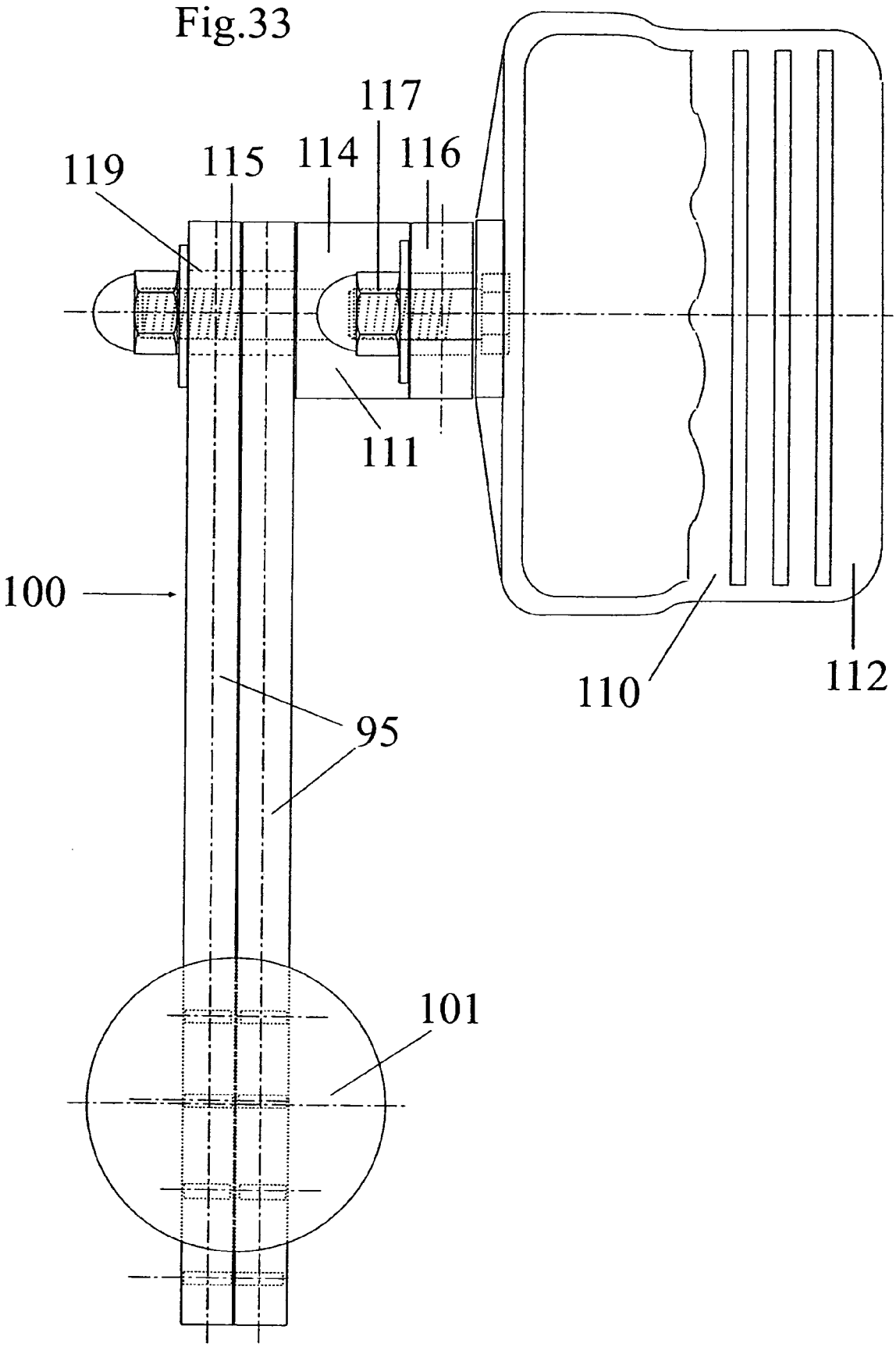
FIG. 33 is side elevational view of an inertial exerciser and entertainment device of a fourth embodiment of the present invention; a twin rotatably mounted distal handle device of a seventh embodiment of the present invention, having a central axle rigidly fixed at a central projecting cylindrical piece of the device, on which any of the different pendulums embodiments described above can be mounted.
Figure 34:
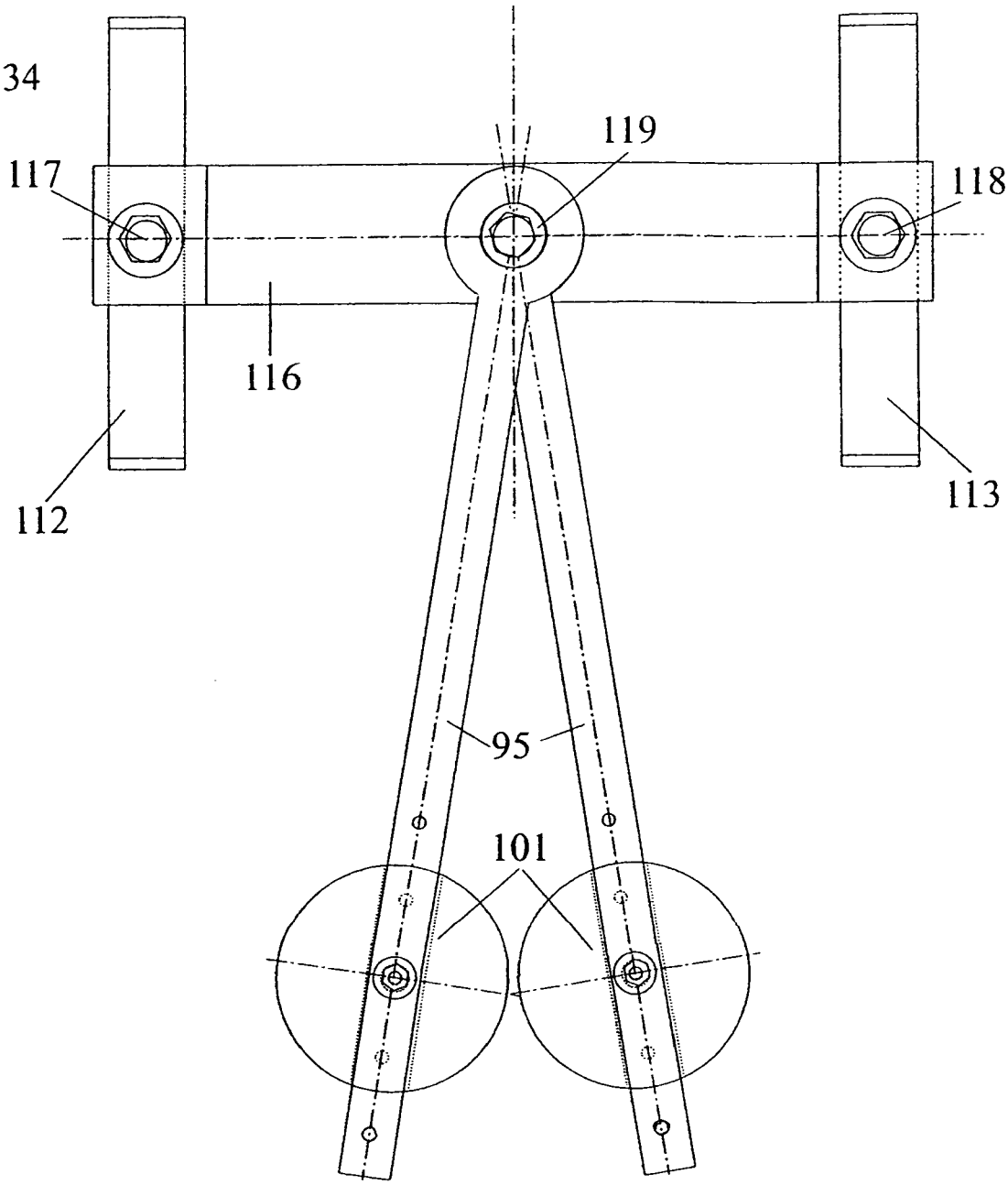
FIG. 34 is a cutaway top view of the inertial exerciser and entertainment device of the embodiment of FIG. 33; twin rotatably mounted distal handle device of the embodiment of FIG. 33 in which both movable distal handles are illustrated, any of the different pendulums may be mounted on the projecting axle.
Figures 35, 36:
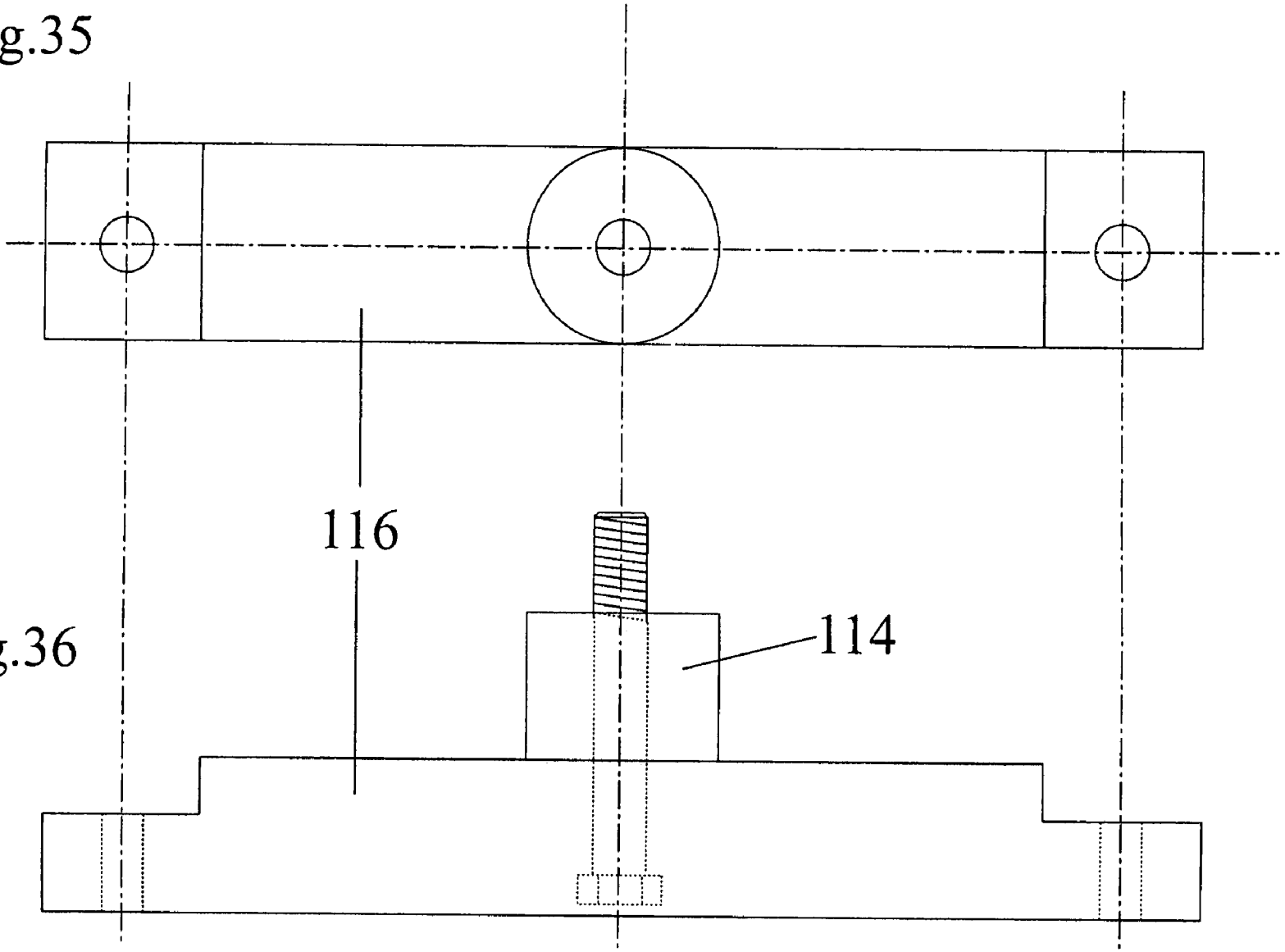
FIG. 35 is a top view of the elongated member of the inertial exerciser and entertainment device of the embodiment of FIG. 33; twin handle device of the embodiment of FIG. 33 where the holes or hubs of the axles of the lateral handles are inserted or rotatably mounted, the central projecting axle where the pendulums are rotatably mounted are also shown.
FIG. 36 is a side view of the elongated member of the inertial exerciser and entertainment device of the embodiment of FIG. 33.

An alternative embodiment of the inertial exerciser and entertainment device 1*d* is shown in FIGS. 30-32. In this alternative embodiment, as shown in FIG. 30, each weight 36 may be mounted on the end of a pendulum rod 32, 33, 34, 35 of one of the pendulums. Each weight 36 may be mounted on the end of a pendulum rod in any suitable manner such as, for example by a bolt, or welding. As shown in FIGS. 30-32, in this alternative embodiment, each spherical weight 36 is provided with a central diametric through hole having a rectangular cross section and through which a fixing screw is introduced. A fixing screw assembly may include a fixing screw, a washer, and a bolt. In this alternative embodiment, each pendulum rod includes a plurality of holes at one end thereof and an eyelet and eyelet hole at the other end. As in the embodiment of FIGS. 27-29, each pendulum includes a pair of pendulum rods, and the pendulums are assembled onto the exerciser in an alternating manner such that one pendulum rod of each pendulum is positioned between the pendulum rods of the other pendulum. The fixing screw assembly is provided to attach a weight 36 to a respective pendulum rod via one of the plurality of holes. The user may choose one of the plurality of holes to which the weight will be attached, in order to provide the desired resistance. In this manner, the inertial exerciser and entertainment device of the present invention is adjustable. Accordingly, the user configures the device for a custom workout particularly suited to his or her particular needs. In this regard, by changing the distance of the weight from the axle, the inertia produced by the oscillating or rotating motion is increased or decreased proportionally. Additionally, different pairs of weights having different masses, may be attached to the pendulum rods. In this manner, the exerciser may be further adapted to the user's requirements, level of training, strength, and expertise. Additionally, as shown in FIG. 30, each weight 36*a*, 36*b* is eccentrically provided on a respective pendulum. As shown in FIGS. 31 and 32, each weight 36*a*, 36*b* includes eccentric through holes that permit the eccentric mounting of each weight 36*a*, 36 on a pair of pendulum rods 32, 33, 34, 35.

FIGS. 33-36 illustrate a fourth embodiment of the improved inertial exerciser and entertainment device 100 of the present invention. The exerciser of the fourth embodiment includes a pair of handles for holding the exerciser with both hands. Exerciser 100 of the fourth embodiment includes an elongated longitudinal bar member 116 having a projecting central axle 114 on which is mounted a pair of pendulums, and a pair of outer axles on which are mounted a pair of rotatable distal handles 112, 113. The handles 112, 113 may be attached to the elongated bar member 116 via bolts 117, 118. Each pendulum 95 includes an elongated pendulum rod, a substantially spherical weight 101 provided on one end of the pendulum rod, and an eyelet having an eyelet hole 119 therethrough. The weights 101 may be provided on the pendulums 95 in any suitable manner such as, for example, by mounting or by providing each weight unitarily and in one piece with a respective pendulum. In the fourth embodiment of the present invention, any of the above described embodiments of different pendulums and weights may be mounted on the projecting central axle of the elongated bar member 116.

Although the invention has been described with reference to exemplary embodiments, it is understood that the words that have been used are words of description and illustration, rather than words of limitation. Changes may be made within the purview of the appended claims, as presently stated and as amended, without departing from the scope and spirit of the invention in its aspects. Although the invention has been described with reference to particular means, materials and embodiments, the invention is not intended to be limited to the particulars disclosed. Rather, the invention extends to all functionally equivalent structures, methods, and uses such as are within the scope of the appended claims.

What is claimed:

1. An inertial exerciser, comprising:

a central axle, said central axle extending in a longitudinal direction defining an axis of rotation;

a handle;

a first pendulum rotatably mounted on said central axle, said first pendulum including a pendulum rod having a first end and a second end, said second end of said first pendulum rod including a first eyelet and a first eyelet hole therethrough configured to receive said central axle, said first eyelet defining a first plane, transverse to said axis of rotation;

a first weight provided on said first end of said first pendulum rod, said first weight including a center of mass defining a second plane transverse to said axis of rotation and spaced from said first plane;

a second pendulum rotatably mounted on said central axle, said second pendulum including a pendulum rod having a first end and a second end, said second end of said second pendulum rod including a second eyelet and a second eyelet hole therethrough configured to receive said central axle, said second eyelet defining a third plane, transverse to said axis of rotation; and a second weight provided on said first end of said second pendulum rod, said second weight including a center of mass defining a fourth plane transverse to said axis of rotation and spaced from said third plane;

wherein the center of mass of said first weight and the center of mass of said second weight are aligned to oscillate in one plane;

wherein said first weight is mounted on said first pendulum rod, and said second weight is mounted on said second pendulum rod; and said inertial exerciser further comprising:

a plurality of attachment holes provided along said first end of said first pendulum rod;

a mounting device to mount said first weight on said first pendulum rod via any one of said plurality of attachment holes along said first pendulum rod;

a plurality of attachment holes provided along said first end of said second pendulum rod; and a mounting device to mount said second weight on said second pendulum rod via any one of said plurality of attachment holes along said second pendulum rod.

2. An inertial exerciser, comprising:

an elongated bar member having a first end and a second end;

a handle mounted on said first end of said bar member;

a handle mounted on said second end of said bar member;

a central axle projecting from said bar member between said first and second ends, said central axle defining an axis of rotation;

a first pendulum rotatably mounted on said central axle, said first pendulum including a pendulum rod having a first end and a second end, said second end of said first pendulum rod including a first eyelet and a first eyelet hole therethrough configured to receive said central axle, said first eyelet defining a first plane, transverse to said axis of rotation;

a first weight provided on said first end of said first pendulum rod, said first weight including a center of mass defining a second plane transverse to said axis of rotation and spaced from said first plane;

a second pendulum rotatably mounted on said central axle, said second pendulum including a pendulum rod having a first end and a second end, said second end of said second pendulum rod including a second eyelet and a second eyelet hole therethrough configured to receive said central axle, said second eyelet defining a third plane, transverse to said axis of rotation; and a second weight provided on said first end of said second pendulum rod, said second weight including a center of mass defining a fourth plane transverse to said axis of rotation and spaced from said third plane;

wherein the center of mass of said first weight and the center of mass of said second weight are aligned to oscillate in one plane;

said inertial exerciser further comprising:

a plurality of attachment holes provided along said first end of said first pendulum rod;

a mounting device to mount said first weight on said first pendulum rod via any one of said plurality of attachment holes along said first pendulum rod;

a plurality of attachment holes provided along said first end of said second pendulum rod; and a mounting device to mount said second weight on said second pendulum rod via any one of said plurality of attachment holes along said second pendulum rod.

* * * * *